US006594876B1

(12) United States Patent
Stastny

(10) Patent No.: US 6,594,876 B1
(45) Date of Patent: Jul. 22, 2003

(54) METHOD AND KIT FOR MODIFYING A TRASH CAN TO PREVENT VACUUM LOCK FROM TRASH CAN LINERS

(76) Inventor: Ronald Stastny, 2350 Brookland Dr. North East, Cedar Rapids, IA (US) 52402

( * ) Notice: Subject to any disclaimer, the term of this patent is extended or adjusted under 35 U.S.C. 154(b) by 0 days.

(21) Appl. No.: 10/029,490

(22) Filed: Dec. 20, 2001

(51) Int. Cl.[7] ..... B21K 21/16

(52) U.S. Cl. ..... 29/401.1; 220/495.04; 220/913

(58) Field of Search ..... 29/401.1, 422, 29/433; 220/495.04, 495.06, 366.1, 908.1, 913

(56) References Cited

U.S. PATENT DOCUMENTS

| | | | | | |
|---|---|---|---|---|---|
| 3,611,549 | A | * | 10/1971 | Pope | 29/423 |
| 4,294,379 | A | * | 10/1981 | Bard | 220/495.04 |
| 4,715,572 | A | * | 12/1987 | Robbins et al. | 248/101 |
| 4,890,760 | A | * | 1/1990 | Nicoll et al. | 220/495.04 |
| 5,036,999 | A | * | 8/1991 | Bitsch | 220/627 |
| 5,265,755 | A | * | 11/1993 | McArthur et al. | 220/601 |
| 5,375,732 | A | * | 12/1994 | Bowers et al. | 220/676 |
| 5,388,717 | A | * | 2/1995 | LeVasseur | 220/495.06 |
| 5,390,818 | A | * | 2/1995 | LaBuda | 220/676 |
| 5,492,241 | A | * | 2/1996 | Barnett et al. | 220/694 |
| 5,690,247 | A | * | 11/1997 | Boover | 220/495.11 |
| 5,794,670 | A | * | 8/1998 | LaFleur | 141/314 |
| 5,803,303 | A | * | 9/1998 | Timm et al. | 220/495.04 |
| 5,843,768 | A | * | 12/1998 | Lin et al. | 435/290.1 |
| 6,000,571 | A | * | 12/1999 | Brooks et al. | 220/495.04 |
| 6,015,063 | A | * | 1/2000 | Poliquin | 220/495.04 |
| 6,223,927 | B1 | * | 5/2001 | Rand | 220/495.06 |
| 6,474,495 | B1 | * | 11/2002 | Frei | 220/495.08 |

* cited by examiner

*Primary Examiner*—Gregory Vidovich
*Assistant Examiner*—Essama Omgba

(57) ABSTRACT

A method and kit for modifying an existing trash can to minimize or to prevent the occurrence of a vacuum seal that may occur when a trash can liner is pulled out of the trash can. The method comprises making three holes substantially close to each other into a trash can wall near the opening of the trash can. Then threading one end of a conduit through one of the holes so that the first end of the conduit reaches deep within the inside of the trash can and the other end of the conduit extending through the hole and outside of the trash can. The two remaining holes are used to securely mount the conduit onto the inside surface of the trash can by threading a tie through these two holes and around the conduit. In modifying an existing trash can by this method, the vacuum seal that often is encountered experience when pulling the trash liner from a trash can is avoided because the conduit allows air to freely pass into the bottom of the trash can. The kit comprises a conduit, drill bit and a tie.

12 Claims, 2 Drawing Sheets

METHOD AND KIT FOR MODIFYING A TRASH CAN TO PREVENT VACUUM LOCK FROM TRASH CAN LINERS

FIELD OF THE INVENTION

The present invention relates to a method and kit for modifying a trash can, and more particular pertains to a method and kit for modifying a trash can in order to prevent vacuum lock from trash can liners for use in connection with pulling the trash can liner out of a trash can.

DESCRIPTION OF THE PRIOR ART

Trash can liners can become stuck within a trash can by a vacuum seal created when the trash can liner contacts the sidewalls of the trash can. When this happens it can be difficult, particularly for weak and infirm individuals, to physically pull the trash can liner out of the trash can. It would be a benefit, therefore, to have a trash can venting system that could be added to modify an existing trash can so as to prevent or to minimize this vacuum seal nuisance.

The use of trash can vent systems are is known in the prior art. For example, the trash can vent system disclosed by Polliquin in U.S. Pat. No. 6,015,063 discloses a vent system that is securable to the trash can lid and vents through a vent channel that is suspended downwardly into the inside of the trash can. However, the Polliquin disclosure does not have a means of attaching the venting device through the trash can wall as well as a means of attaching the venting device onto the inside wall of the trash can without attachment to the trash can lid. As a result the Polliquin disclosure suffers a number of drawbacks. One drawback of the Polliquin disclosure is that it is likely to be knocked off of its mounting when the trash liner is removed. Another drawback is that the Polliquin disclosed device is likely to be relatively expensive to produce. Furthermore, another drawback to the Polliquin disclosed device is that it is not universally attachable to all trash cans and thus the user will likely be burdened to locate one of Polliquins devices that will particularly fit the users individual trash can.

Another strategy in trying to eliminate vacuum seal from trash can liners has been to incorporated the conduit as an integral component of the trash can itself. Examples of this integral component strategy can be found in the vacuum release garbage can disclosed by Bowers and Sherman in U.S. Pat. No. 5,375,732; the upward vented trash receptacle for flexible collapsible trash liner disclosed by Bart in U.S. Pat. No. 4,294,379; and the waste collecting container with a ventilating device disclosed by Bitsch in U.S. Pat. No 5,036,999. These disclosed designs necessarily require the user to discard the users existing trash can and replace it with one of these integral component trash cans. Therefore, these devices suffer a number of disadvantages, in particular, it is likely to be more costly to obtain one of these trash cans rather than to modify an existing trash can. Furthermore, these designs will likely be ecologically undesirable because it would require the user to discard his present trash can.

Finally, another strategy in trying to eliminate the vacuum seal encountered from pulling on trash can liners has been to incorporate a scalloped trash can wall. The trash bag retainer and air venting device disclosed by Robbins and Schwerner in U.S. Pat. No. 4,715,572 discloses a scalloped walled trash can design which allows venting of air from the exterior outside atmosphere to the interior chamber between the bottom of the trash can and the trash can liner. The same drawbacks mentioned above are applicable here. That is, the Robbins and Schwerner disclosed device is likely to be an ecological and economical burdensome device and thus is inherently undesirable in comparison to a much more simpler and economical method and kit to modify existing trash cans.

While all of the above-described devices fulfill their respective, particular objectives and requirements, the aforementioned patents do not describe a multipurpose storage unit that allows a user to individually tailor make a pill box that would specifically match the user's particular individual needs. The above-described patents make no provision for securing a vacuum vent system through a wall of existing trash and as a consequence the prior art strategies are likely to be considerably more expensive and ecologically costly because most of the prior art solutions offer the only solution to discard the existing trash can and to replace it with the prior art devices.

Therefore, a need exist for a new and improved method and kit for modifying a trash can to prevent vacuum lock from trash can liners which is economical, convenient and ecologically feasible. In this respect, the method and kit for modifying a trash can to prevent vacuum lock from trash can liners according to the present invention substantially departs from the conventional concepts and designs of the prior art, and in doing so provides an apparatus primarily developed for the purpose of modifying existing trash cans to avoid the nuisance vacuum seals encountered from pulling up filled trash can liners from trash cans.

SUMMARY OF THE INVENTION

A method of modifying an existing trash can to minimize or to prevent the occurrence of a vacuum seal that may occur when a trash can liner is pulled out of the trash can. The method comprises making three holes substantially close to each other into a trash can wall near the opening of the trash can. Then threading one end of a conduit through one of the holes so that the first end of the conduit reaches deep within the inside of the trash can and the other end of the conduit extending through the hole and outside of the trash can. The two remaining holes are used to securely mount the conduit onto the inside surface of the trash can by threading a tie through these two holes and around the conduit. In modifying an existing trash can by this method, the vacuum seal that often is encountered experience when pulling the trash liner from a trash can is avoided because the conduit allows air to freely pass into the bottom of the trash can. The kit comprises a conduit, drill bit and a tie.

In view of the foregoing disadvantages inherent in the known type of trash can ventilation systems now present in the prior art, the present invention provides an improved method and kit for modifying a trash can to prevent vacuum lock from trash can liners, which will be described subsequently in great detail, is to provide a new and improved method and kit for modifying a trash can to prevent vacuum lock from trash can liners which is not anticipated, rendered obvious, suggested, or even implied by the prior art, either alone or in any combination thereof.

To attain this, the present invention essentially comprises making three holes substantially close to each other into a trash can wall near the opening of the trash can. Then threading one end of a conduit through one of the holes so that the first end of the conduit reaches deep within the inside of the trash can and the other end of the conduit extending through the hole and outside of the trash can. Threading a tie through the two other holes and around the conduit to securely mount the conduit onto the inside wall of the trash can. In modifying an existing trash can by this method, the vacuum seal that often is encountered experience when pulling the trash liner from a trash can is avoided because the conduit allows air to freely pass into the bottom of the trash can.

There has thus been outlined, rather broadly, the more important features of the invention in order that the detailed description thereof that follows may be better understood, and in order that the present contribution of the art may be better appreciated.

The present method invention may also include the additional step of mounting a collar around the end of the collar which is positioned outside of the trash can so that this end does not get pulled into the trash can. The advantage realized by having this additional feature adds another means of securing the conduit in place. The present invention may also include the additional step of cutting the end of the conduit that is positioned inside the trash can at an angle substantially at forty five degrees. The advantage realized by having this additional feature is that the conduit orifice is less likely to be plugged by any unwanted debris within the bottom of the trash can. There are of course, additional features of the invention that will be described hereinafter and which will form the subject matter of the claims attached.

The present kit invention may also include the additional items as a second drill bit for making small holes for holding the tie around the conduit against the inside of the wall. The kit may also have the additional element of a pair of scissors or a knife for cutting the conduit as well as using the scissors to make the three holes. Furthermore, the present kit invention may include a tie is selected from the group consisting of a plastic tie, a wire, a nylon string.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved method and kit for modifying a trash can to prevent vacuum lock from trash can liners that has all the advantages of the prior art trash can ventilation systems and none of the disadvantages.

It is another object of the present invention to provide a new and improved method and kit for modifying a trash can to prevent vacuum lock from trash can liners that may be easily and efficiently manufactured and marketed.

An even further object of the present invention is to provide a new and improved method and kit for modifying a trash can to prevent vacuum lock from trash can liners that has allows the user to realize a low cost associated with the necessary materials and a minimal amount of time necessary to modify each trash time, thereby making such multipurpose storage unit and system economically available to the buying public.

Still another object of the present invention is to provide a new method and kit for modifying a trash can to prevent vacuum lock from trash can liners that provides in the methods of the prior art some of the advantages thererof, while simultaneously overcoming some of the disadvantages normally associated therewith.

Even still another object of the present invention is to provide a method and kit for modifying a trash can to prevent vacuum lock from trash can liners without having to discard an existing trash can and thus making available an ecological as well as an economical advantageous method to prevent vacuum lock created by trash can liners.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompany drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DETAILED DESCRIPTION OF THE PREFERRED EMBODIMENT

Figure 1:
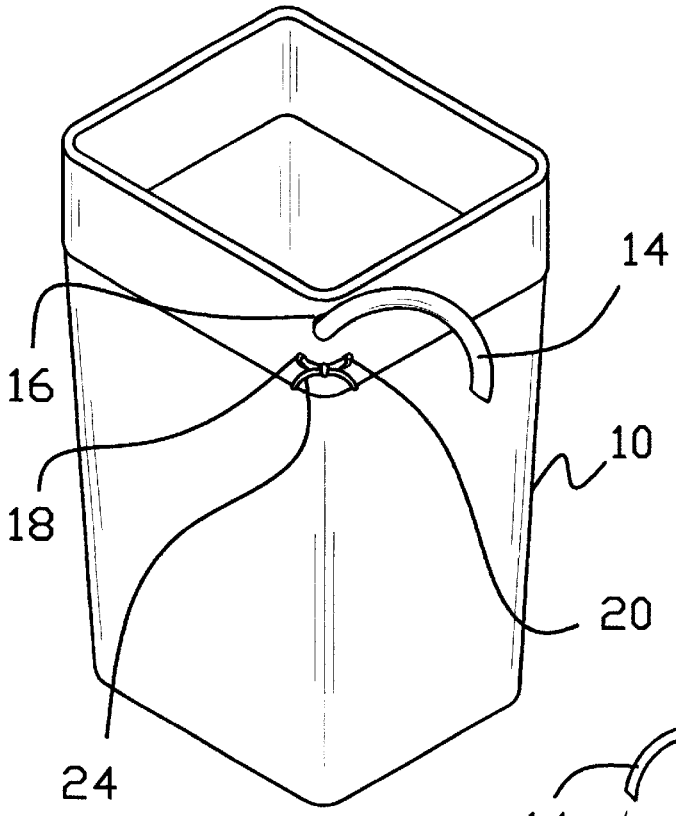
FIG. 1 is a perspective view of a modified trash can constructed in accordance with the principles of the present invention.
Figure 2:
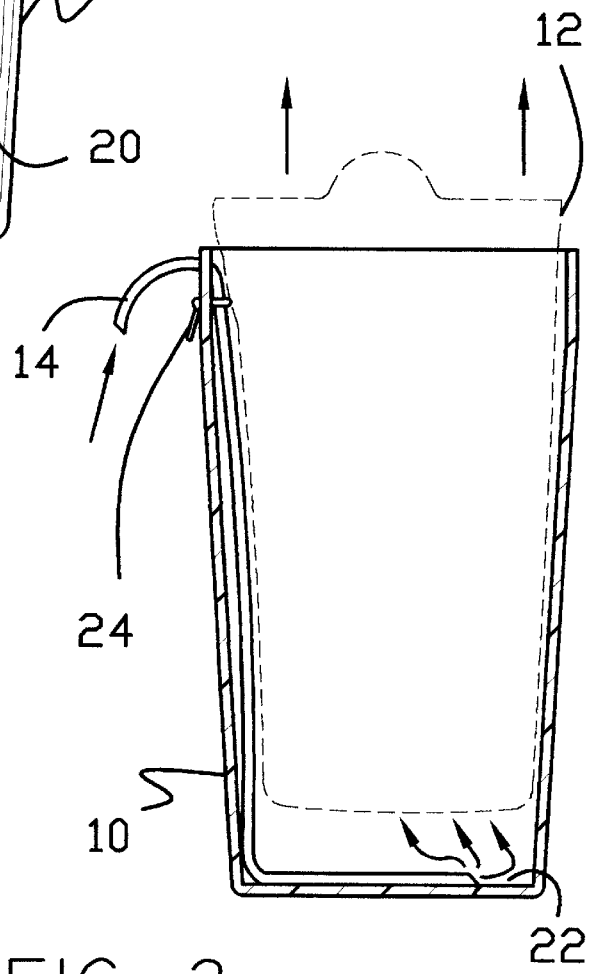
FIG. 2 is a cross sectional view of a modified trash can constructed in accordance with the principles of the present invention.
Figure 3:
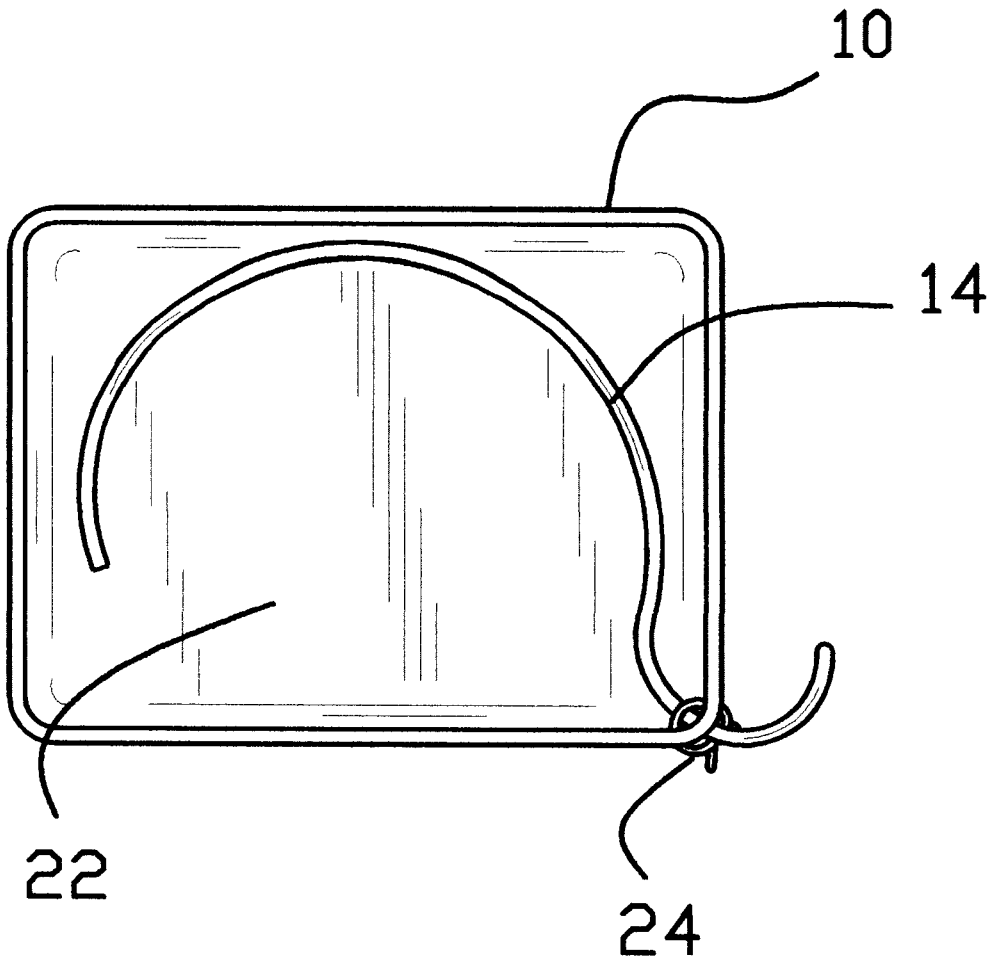
FIG. 3 is a top view of a modified trash can constructed in accordance with the principles of the present invention.

Referring now to the drawings, and in particular FIGS. 1 to 3 thereof, one preferred embodiment of the present invention is shown and generally designated by the reference number, where the an existing trash can 10 which is modified to minimize or to prevent the occurrence of a vacuum seal that may occur when a trash can liner 12 is pulled out of the trash can 10, said method comprising: obtaining a conduit 14 having a length at least the height of the trash can 10. Making a first hole 16 through a wall of the trash can 10 and at a position substantially near the opening of the trash can 10. Producing a second hole 18 through the wall of the trash can 10 and at a position below and to the right of the first hole 16 when the trash can 10 is upright. Creating a third hole 20 through the wall of the trash can 10 and at a position below and to the left of the first hole 16 when the trash can 10 is upright. Aligning the conduit 14 through the first hole 16 so that the first end extends inside of the trash can 10 towards the inside bottom 22 of the trash can 10 and that the second end extends outside of the trash can 10. Finally, securing a portion of the conduit 14 that is within the trash can 10 with a tie 24 mounted through the second hole 18 and third hole 20.

In FIG. 1, a new and improved method of modifying a trash can 10 to prevent vacuum lock from trash can liners 12 shows a perspective view of a modified trash can 10 of the present invention having one end of an internally placed conduit 14 positioned outside of the trash can 10 through a first hole 16. The other end of the conduit 14 is not illustrated but positioned inside the trash can 10 at or near the inside bottom 22 of the trash can 10. This positioned conduit 14 allows air to pass through the conduit 14 into the bottom chamber below a trash can liner 12 so that a vacuum seal is prevented between the trash can 10 and the trash can liner 12 when a user pulls the trash can liner 12 from the trash can 10. Also shown in FIG. 1 is a tie 24 which is used to securely mount a portion of the conduit 14 against the inside wall of the trash can 10 by threading the tie 24 through the second hole 18 over the conduit 14 and through the third hole 20.

Referring now to FIG. 2, a new and improved of modifying a trash can 10 to prevent vacuum lock from trash can liners 12 shows a cross sectional view of a modified trash can 10 containing a trash can liner 12. The one end of the conduit 14 is positioned outside of the trash can 10 and the other end of the conduit 14 is at or near the bottom of the trash can 10 and below the trash can liner 12. When a user pulls up on the trash can liner 12 air is drawn in through the exterior and into the interior of the trash can 10 through the conduit 14 and thereby eliminating the vacuum seal between the trash can 10 and the trash can liner 12. Also shown is a tie 24 which is used to securely mount a portion of the conduit 14 against the inside wall of the trash can 10 by threading the tie 24 through the second hole 18 over the conduit 14 and through the third hole 20.

Referring now to FIG. 3, a new and improved method and kit for modifying a trash can to prevent vacuum lock from trash can liners 12 shows a top view of a modified trash can 10 without a trash can liner 12. The portion of the conduit 14 within the trash can 10 is positioned so that it loops around the bottom of the trash can 10. Also shown is a tie 24 which is used to securely mount a portion of the conduit 14 against the inside wall of the trash can 10 by threading the tie 24 through the second hole 18 over the conduit 14 and through the third hole 20.

As to the manner of usage and operation of the present invention, the same should be apparent from the above description. Accordingly, no further discussion relating to the manner of usage and operation will be provided.

While a preferred embodiment of the method and kit for modifying a trash can to prevent vacuum lock from trash can liners has been described in detail, it should be apparent that modifications and variations thereto are possible, all of which fall within the true spirit and scope of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any sturdy cutting device such as a box cutter or even a pair of scissors may be used to cut the ends of the conduit. Furthermore, any sturdy cutting device such as box cutters or a sharpened screw driver may be used to cut into the trash can wall to form the various holes in an existing trash can instead a knife or drill bit. Also, the tie may be made of any number of different materials, such as cotton string, hemp rope, polyester cord, or even leather, instead of the wire or nylon string.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of modifying an existing trash can to minimize or to prevent the occurrence of a vacuum seal that may occur when a trash can liner is pulled out of the trash can, said method comprising:

obtaining a conduit having a length at least the height of the trash can;

making a first hole through a wall of the trash can and at a position substantially near the opening of the trash can;

producing a second hole through the wall of the trash can and at a position below and to the right of the first hole when the trash can is upright;

creating a third hole through the wall of the trash can and at a position below and to the left of the first hole when the trash can is upright;

aligning the conduit through the first hole so that a first end extends inside of the trash can towards the inside bottom of the trash can and that a second end extends outside of the trash can;

securing a portion of the conduit that is within the trash can with a tie mounted through the second and third holes; and cutting the first end of the conduit at substantially forty five degrees.

2. The method as described in claim 1 wherein said making a first hole is by drilling a hole through the wall of the trash can with a drill bit attached to an electric drill.

3. The method as described in claim 1 wherein said making a first hole is by burning a hole through the wall of the trash can with a hot probe.

4. The method as described in claim 1 wherein said making a first hole is by cutting a hole through the wall of the trash can with a knife.

5. The method as described in claim 1 wherein said producing a second hole is by drilling a hole through the wall of the trash can with a drill bit attached to an electric drill.

6. The method as described in claim 1 wherein said producing a second hole is by burning a hole through the wall of the trash can with a hot probe.

7. The method as described in claim 1 wherein said producing a second hole is by cutting a hole through the wall of the trash can with a knife.

8. The method as described in claim 1, wherein said first hole is within three inches of the opening of the trash can.

9. The method as described in claim 1, wherein said second hole is positioned within four inches of said first hole.

10. The method as described in claim 1, wherein said third hole is positioned no more than three inches laterally from the second hole.

11. A method of modifying an existing trash can to minimize or to prevent the occurrence of a vacuum seal that may occur when a trash can liner is pulled out of the trash can, said method comprising:

obtaining a conduit having a length at least the height of the trash can;

making a first hole through a wall of the trash can and at a position substantially near the opening of the trash can;

producing a second hole through the wall of the trash can and at a position below and to the right of the first hole when the trash can is upright;

creating a third hole through the wall of the trash can and at a position below and to the left of the first hole when the trash can is upright;

aligning the conduit through the first hole so that a first end extends inside of the trash can towards the inside bottom of the trash can and that a second end extends outside of the trash can; and securing a portion of the conduit that is within the trash can with a tie mounted through the second and third holes.

12. The method as described in claim 11, further comprising:

cutting the first end of the conduit at substantially forty five degrees.

* * * * *